US006473994B1

(12) United States Patent
Dedieu et al.

(10) Patent No.: US 6,473,994 B1
(45) Date of Patent: Nov. 5, 2002

(54) METHOD FOR DRYING SAW TIMBER AND DEVICE FOR IMPLEMENTING SAID METHOD

(75) Inventors: Bernard Dedieu, Olivet; Abdelaâziz Bouirdène, Balma, both of (FR)

(73) Assignee: Valeurs Bois Industrie, Saran (FR)

( * ) Notice: Subject to any disclaimer, the term of this patent is extended or adjusted under 35 U.S.C. 154(b) by 0 days.

(21) Appl. No.: 09/530,326

(22) PCT Filed: Oct. 29, 1998

(86) PCT No.: PCT/FR98/02318

§ 371 (c)(1),
(2), (4) Date: Jul. 6, 2000

(87) PCT Pub. No.: WO99/23429

PCT Pub. Date: May 14, 1999

(51) Int. Cl.[7] ..... F26D 7/00

(52) U.S. Cl. ..... 34/396; 34/259; 34/263; 34/265; 34/487; 34/493; 34/198; 219/682; 219/690; 219/695; 219/700

(58) Field of Search ..... 34/259, 263, 265, 34/487, 493, 497, 197, 198, 216, 217, 219, 396; 144/380; 219/682, 690, 695, 700, 756

(56) References Cited

U.S. PATENT DOCUMENTS

| | | | | | |
|---|---|---|---|---|---|
| 3,721,013 | A | * | 3/1973 | Miller | 34/265 |
| 3,845,270 | A | | 10/1974 | Widugris | |
| 3,986,268 | A | * | 10/1976 | Koppelman | 34/257 |
| 4,343,095 | A | | 8/1982 | Rosen | |
| 4,447,402 | A | | 5/1984 | Cox | |
| 4,469,156 | A | * | 9/1984 | Norimoto et al. | 144/380 |
| 4,488,361 | A | | 12/1984 | Loof | |
| 4,862,599 | A | * | 9/1989 | Brunner | 34/536 |
| 4,893,415 | A | * | 1/1990 | Moldrup | 34/406 |
| 5,195,251 | A | * | 3/1993 | Gyurcsek et al. | 34/489 |
| 5,247,975 | A | * | 9/1993 | Tanahashi et al. | 144/271 |
| 5,343,913 | A | * | 9/1994 | Tanahashi et al. | 144/380 |
| 5,558,800 | A | * | 9/1996 | Page | 219/761 |
| 6,105,278 | A | * | 8/2000 | Gerrish et al. | 34/497 |

FOREIGN PATENT DOCUMENTS

| | | |
|---|---|---|
| DE | 517 714 C | 9/1929 |
| EP | 0 505 586 | 9/1992 |
| GB | 2 306 090 A | 4/1997 |
| WO | WO 82 01411 A | 4/1982 |
| WO | WO 82 01766 A | 5/1982 |
| WO | WO 93 02842 A | 2/1993 |

* cited by examiner

*Primary Examiner*—William C. Doerrler
*Assistant Examiner*—Mark Shulman
(74) *Attorney, Agent, or Firm*—Nixon & Vanderhye P.C.

(57) ABSTRACT

The invention relates to a process for drying wood, characterized in that it comprises a pressurizing step to place a sealed chamber (1) under a predetermined pressure by injecting or generating saturating steam and maintaining this pressure for a predetermined time interval, while ensuring a forced circulation of air and saturating steam within the chamber, a heating step to heat the wood core and central zone of the wood pieces by emitting microwaves at frequencies ranging between 400 and 2450 MHz, an evacuation step to carry away the liquid exudates from the wood which run down to the bottom of the chamber (1) where they are collected.

33 Claims, 3 Drawing Sheets

METHOD FOR DRYING SAW TIMBER AND DEVICE FOR IMPLEMENTING SAID METHOD

The present invention relates to a process for drying sawmill timber and wood items.

The invention is particularly useful for the treatment of "sawmill timber". By the wording "sawmill timber" is meant timber directly derived from initial processing (sawing).

A process is known from patent application WO 82/01766 for drying timber which uses microwaves at a frequency of 915 MHz applied to wood to be dried in order to raise its inner temperature and cause it to discharge water. The discharged water is evaporated on the surface of the wood by a circulation of air at low speed obtained using fans. The air with a moisture content of approximately 89% passes over condensers to extract this moisture.

In document WO 82/01411, the same principle is used, but in this latter document it is specified in addition that the temperature of the air must always be lower than the inner temperature of the wood. This document points out the drawback of having to heat the surface area of the material with microwaves before heating the inner part of the material. In this document, it is therefore proposed to control the process of converting magnetic energy into heat energy so as to concentrate the waves on the water within the material. Also, it is suggested to act on the climate within the chamber by maintaining a sufficiently high percentage of air humidity to prevent the surface of the product from drying out before removal of the moisture from the core of the wood. For this purpose, during the initial phase of the drying process, water in atomized form is added to the chamber to maintain a high humidity level.

Similarly, the article published in the review "Holz als roh und werkstoff" in 1995, pages 333 to 338, Springer-Verlag Editions, entitled "Microwave drying of pine and spruce" by A. L. ANTTI describes drying wood with microwaves operating at frequencies of 915 or 2450 MHZ and a power density in the range of 25 to 78 $kW/m^3$ to raise the inner temperature of the wood to approximately 140° C. and achieve a steam pressure inside the wood of 25 KPa. The inner pressure achieved in this way is very high and enables swift evacuation of the water. The disadvantage of the process is that it develops breaks in fibres. The drying process starts by quick microwave drying in the region of 70° C. followed by intermittent exposure to microwaves during drying, and finally a drying operation under wood temperature control to remain below fibre saturation by limiting temperature to a maximum of 110° C.

In all configurations, it is evident that air is used as the vehicle to remove the moisture which exits from the wood. On this account, the air humidity level must remain below the saturation level of air in steam. It is therefore necessary in known systems to de-humidify the air in order to carry out wood drying. Also, it is necessary for the air temperature to be lower than the wood temperature to allow evaporation. All these systems have the disadvantage of generating large energy losses and do not optimise energy consumption. The higher the required wood temperatures, the greater the proportional amount of microwave generating power is required, and since drying times last several hours energy consumption is high and therefore costly. It can be noted in the article cited above that drying times are between 3 and 5 hours depending upon wood thickness and the power of the equipment used. Also, none of these known processes manages to achieve less than 30% moisture content in the wood after drying.

The purpose of the present invention is to put forward a process with which it is possible to optimise energy and reduce the power of the microwave means while rapidly obtaining complete drying of the wood, from the green state to a final moisture content in the order of 10%, or even less depending upon operating conditions.

This purpose is achieved through the fact that the wood drying process comprises:

- a pressurizing step, to place at least one sealed chamber 1 under a determined pressure by injecting or creating saturating steam, and maintaining this pressure for a determined time interval while ensuring forced circulation of air and saturating steam within the chamber;
- a heating step, to heat the wood core and the central part of the wood items to be dried, by emitting microwaves at frequencies of between 400 and 2450 MHz;
- an evacuation step, to carry away the liquid exudates which exit the wood and run down to the bottom of the chamber 1 where they are collected.

According to another particularity, the liquid exudates are permanently evacuated.

According to another particularity, the exudates are intermittently evacuated.

According to another particularity, the evacuation step is followed by a gradual pressure-lowering step down to atmospheric pressure after stoppage of the microwaves.

According to another particularity, the evacuation step comprises physico-chemical treatment of the exudates to make them compatible with evacuation towards the waste water circuit.

According to a further particularity, the liquid exudate evacuation step is followed by a collection step in a container for the purpose of further chemical treatment.

According to another particularity, the pressure-lowering step is completed by a de-humidifying step of ambient air in the chamber by passage of the stream of air from the chamber onto a humidity absorption device and cooling of the air within the chamber.

According to another particularity, the applied microwave emitting powers are of decreasing magnitude from the core of the wood pieces towards the outside.

According to another particularity, the saturating steam pressure is in the range of 2 bars to 15 bars.

According to another particularity, the steam pressure is less than 10 bars to obtain a treated wood moisture content of more than 6%.

According to a further particularity, the steam pressure, at least during a determined drying time, is between 10 and 15 bars and the temperature produced will reach a value lying in the range of 200 to 220° C. to obtain a dry, naturally polymerized wood having a moisture content close to 0%.

According to another particularity, the power of the microwave generator is calculated so that the internal heat of the wood is higher than the temperature of the saturating steam.

A further purpose of the invention is a system enabling the implementation of the process.

This purpose is achieved through the fact that the system is made up of a pressure-resistant sealed chamber communicating via windows in quartz, or any other material suitable for microwaves, with a waveguide that is connected by impedance adapters to a microwave generator, said windows being arranged crosswise to the stack of wood, the chamber being connected to a pressurized air recirculation pathway which aspirates air from one side of the wood stack via grids and repels the air on the other side of the wood stack by means of diffusion grids, and pressurized steam generating means connected to the chamber.

According to another particularity, the system comprises a steam condenser circuit connected in parallel to the air recirculation circuit and in selective manner via valves.

According to another particularity, the system comprises in its lowest part an evacuation outlet operating under gravity to evacuate the exuded waters which is controlled by a valve.

According to another particularity, the system comprises:

one end which can be closed by an automatic door to ensure sealing against pressure and microwaves;

conveying means to transport the green wood loads to be dried, which means are electrically separated from the transport means located on the other side of the automatic airlock in relation to the chamber.

According to another particularity, the unit formed by the chamber and pre-loading zone is encased in a second protective chamber protecting against radiation leakage, this chamber being accessible from the outside via flexible doors.

According to another particularity, the microwave generator is embedded in the ground and communicates with the drying chamber via a waveguide.

According to another particularity, the chamber comprises a safety valve.

According to another particularity, the valve is opened intermittently.

According to another particularity, the valve is opened permanently.

According to a further particularity, the outlet is connected to a physico-chemical treatment system to render the exudates compatible with waste water evacuation standards.

A final purpose of the invention is to put forward a chemical component extraction method using the process and system of the invention consisting of:

treating one single type of green wood species by applying microwaves in an atmosphere of saturating steam under determined pressure and temperature conditions, collecting the liquid exudate produced by the single species treatment operation, optionally re-treating this exudate with physico-chemical methods to remove various chemical components that can be used in the cosmetic, perfume, agro-foodstuffs, pharmaceutical and chemical industries.

According to another particularity, the treatment of pine species leads to obtaining an exudate having insecticide properties.

Other particularities and advantages of the present invention will become clearer on reading the following description made with reference to the appended drawings in which.

Figure 1A:
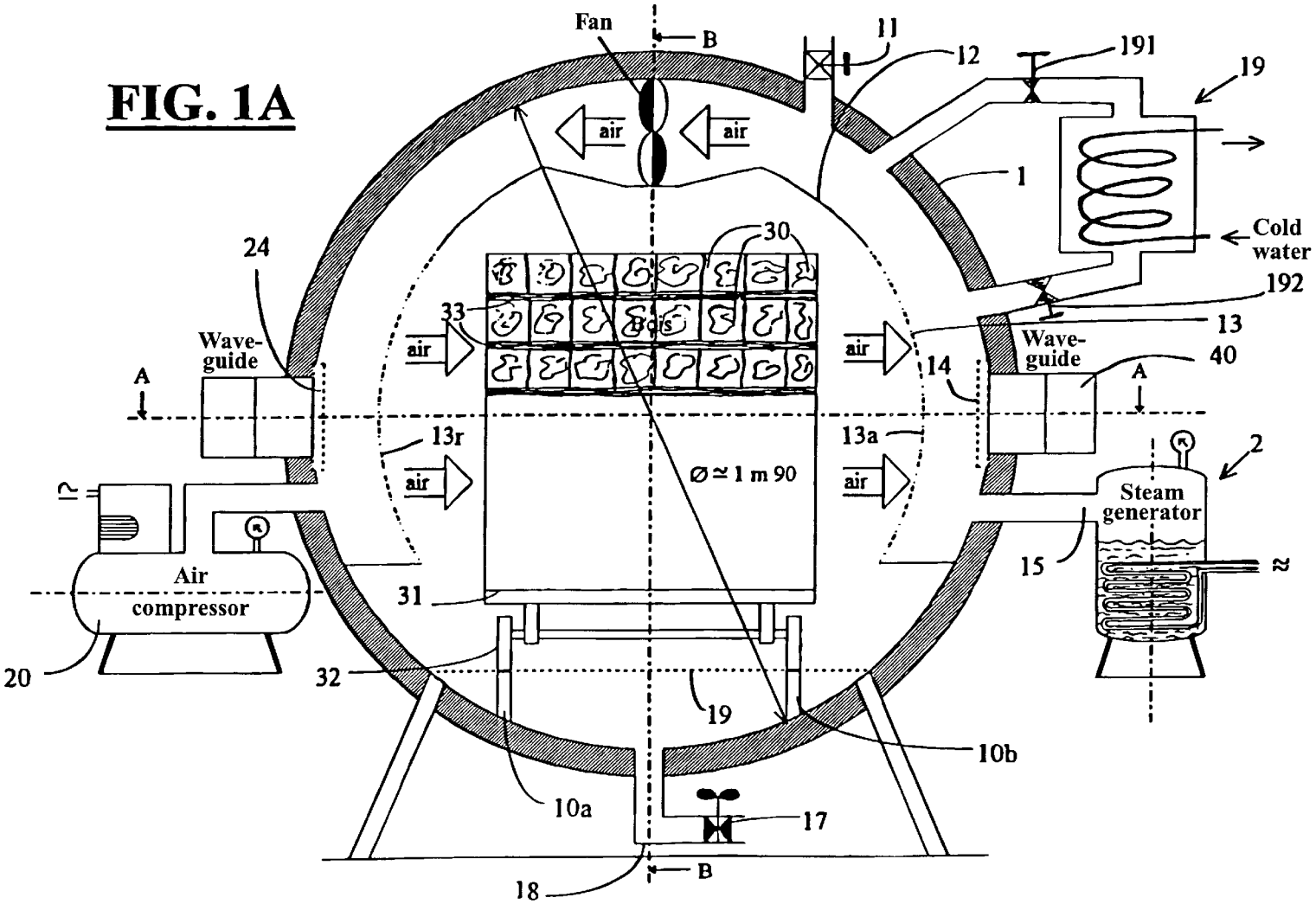
FIG. 1A shows a cross-sectional view of the system of the invention.
Figure 1B:
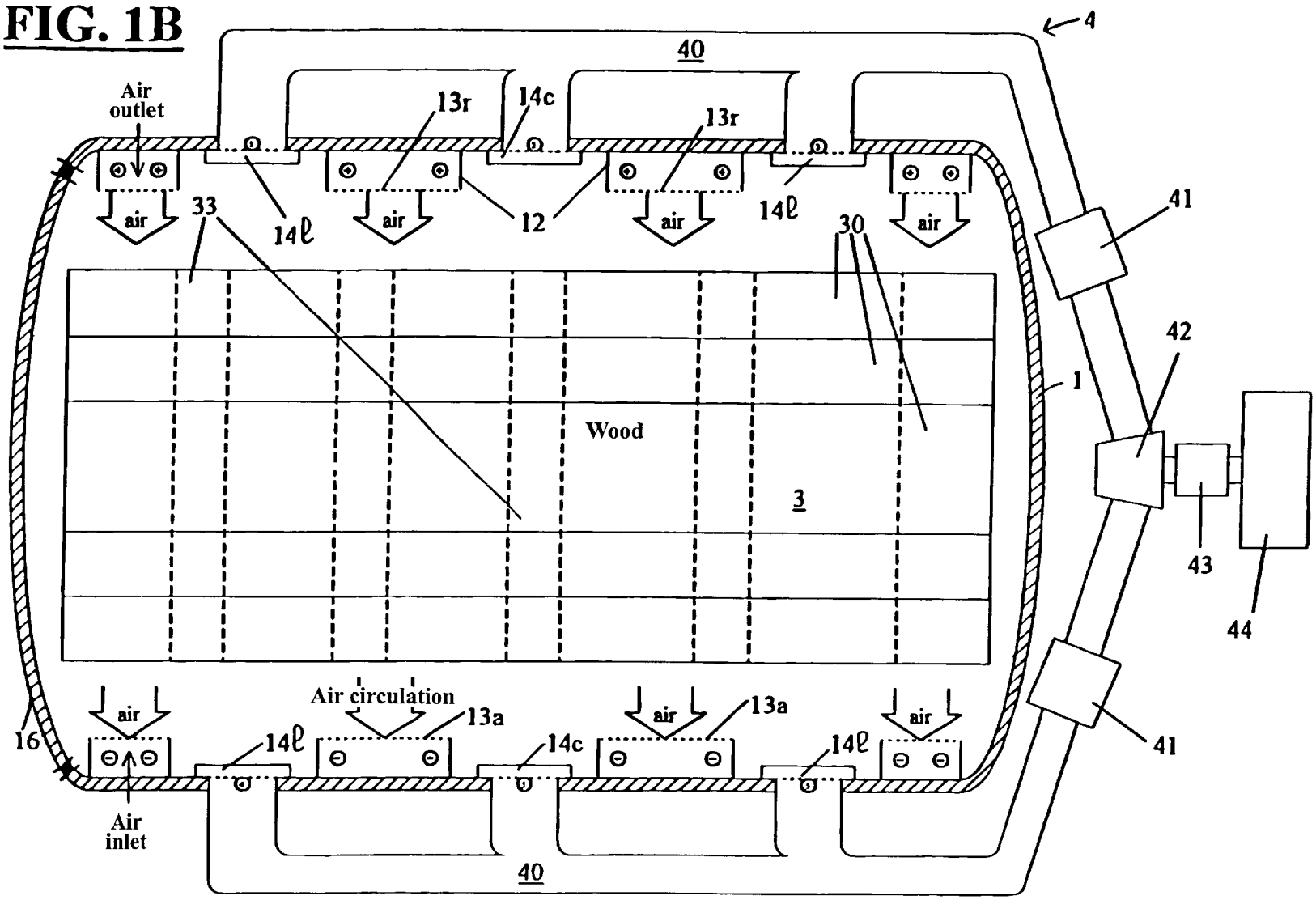
FIG. 1B shows a top view in longitudinal section of the system of the invention

As shown in FIG. 1A, the system is made up of a chamber 1, preferably cylindrical, in metal material ensuring firstly good thermal insulation and secondly sealing against waves and air pressure. This chamber is open at one end by one or two doors 16, FIG. 1B. Openings 14 are made in the chamber to form windows in a material that is air resistant but which allows the passage of microwave radiation. These pressurized windows 14 are in a material enabling waves to be emitted towards the inside of the chamber and are so-called emitting windows. The waves are brought via a waveguide 40 to a plurality of windows arranged longitudinally, whether at regular intervals or not, along each side of the stack of wood 3 to obtain wave distribution as homogeneous as possible. The waveguide 40 communicates via an impedance adapter 41 and a 3-decibel divider 42 with an insulator 43 and a microwave generator 44. Between each emitting window 14 or between the end emitting windows and each chamber bottom a plurality of pipes 12 are preferably arranged for the forced circulation of air via a fan V. These pipes 12, at a height approximately corresponding to the height of the wood stack, communicate via grids 13 with the inner zone of the chamber containing the wood stack 3 conveyed via conveying means, such as for example a wagon made up of wheels 32 mounted on a support platform 31. The wood stack is preferably made up of pieces 30 in the form of beams or planks or boards of any thickness or width derived from sawmills and arranged side-to-side over their width in longitudinal direction to form one layer. Each layer of wood is separated from the lower layer by battens or sticks 33 arranged perpendicularly but not in abutted manner to form passageways between the side-to-side layers of wood pieces for the circulation of air, waves and water. The air circulation circuit is also made in a material which promotes the reflection of waves towards the inside of the chamber and wood stack. The chamber is connected by piping 15 to a steam generator system 2 and optionally to an air compressor 20. The humidity arrives from the steam regenerator via diffusion grids 13 to enable homogenous distribution within the chamber with no risk of attacking the wood head-on. The air compressor 20 is used to produce compressed air intended to accelerate the circulation of water in the wood, and when the steam generator system 2 is unable to generate steam under sufficient pressure to reach the desired temperature, or to accompany the rise in temperature and accelerate the circulation of wood water. On the other hand, if a steam generating system under sufficient pressure is used to reach the desired temperatures and pressures, the air compressor may be omitted. The wagon wheels rest on rails 10A, 10B integral with the bottom of the chamber 1 and are equipped with an electric arc eliminating device. A grid 19 prevents the propagation of waves towards the liquid exudates or run-off waters collected in the bottom of the chamber. These run-off waters are evacuated via piping 18 controlled by a valve 17. This piping 18 leads to a container, that can be removed or emptied, which collects the liquid exudates resulting from the drying process. In one variant, this opening is permanently open or intermittently open. In another variant, the piping leads to a physico-chemical treatment system to render the exudate compatible with standards in force for waste waters. Finally, the upper part of the chamber comprises a safety valve 11 which is provided to maintain the chamber at the desired pressure, to evacuate pressure if it is too high and finally to place the chamber under atmospheric pressure once the drying process is completed.

Figure 2:
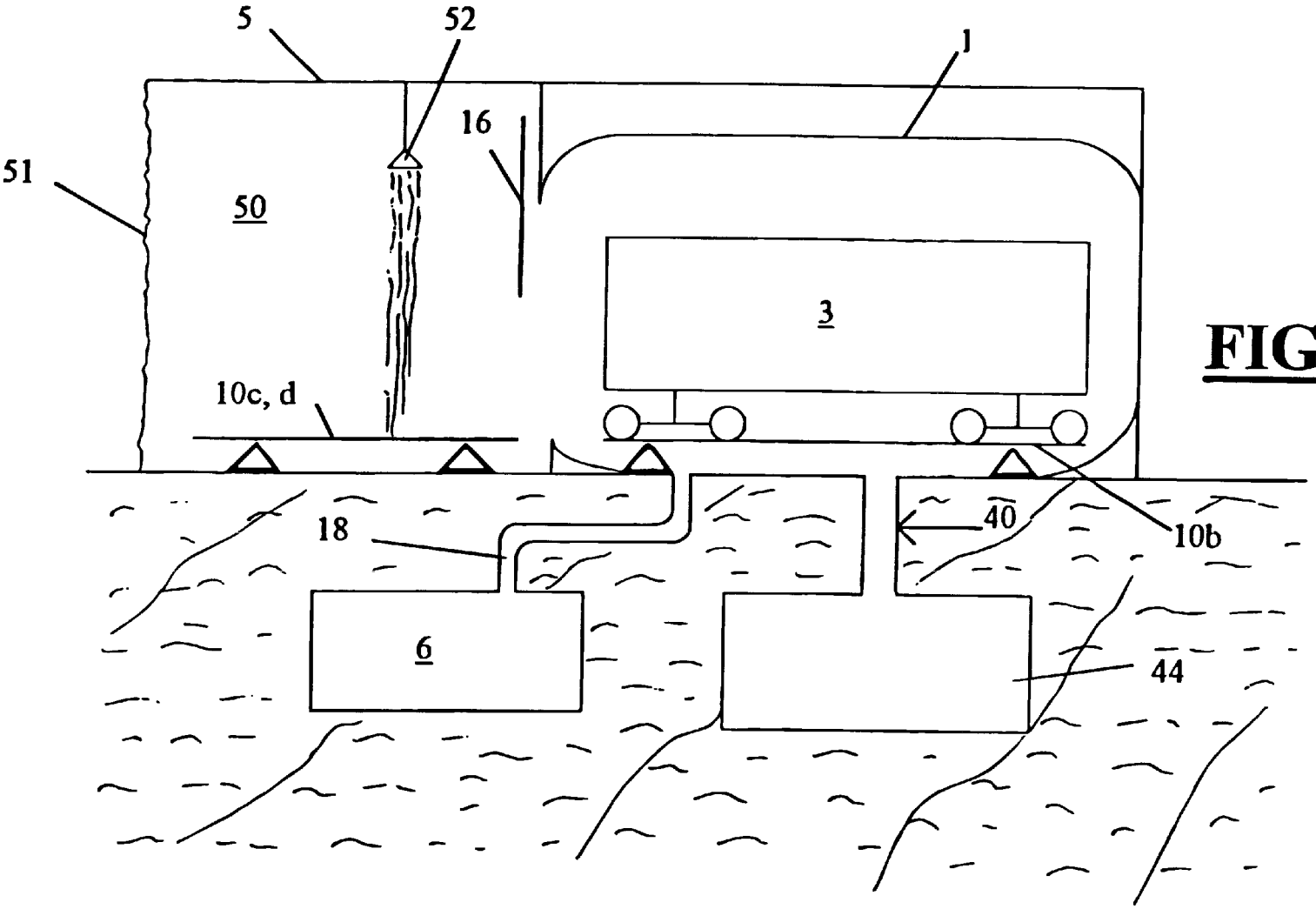
FIG. 2 shows a side view of the system when set up.

In the lay-out diagram shown in FIG. 2, the vessel 1 is enclosed in a chamber 5 connected via the airlock of door 16 automatically controlled at the start and finish by an electronic control system. A pre-loading zone 50 is used to bring the wagons on a pair of rails 10C, 10D which are not electrically connected to rails 10A, 10B of chamber 1. A vaporisation system 52 is used to sprinkle water during the microwave application stage to prevent any leakage of radiation towards the outside. A reserve vessel, not shown, that can be removed and emptied, is connected to chamber 1 by piping 18 and is used to collect the liquid exudates resulting from the wood drying. In order to ensure leakage reduction, the microwave generator 44 is buried like the reserve vessel 6 and is connected to the drying chamber 1 via waveguide 40.

The drying process consists of the following operations: placing by transfer means a load of green wood inside the chamber; automatic closing of the chamber door, preferably to prevent any handling errors or shocks; placing the chamber under pressure and diffusion of saturating steam in the chamber until a pressure is reached corresponding to the desired operating temperature under saturating steam. A pressure of 2 bars may be used for a saturating steam temperature of 120° Celsius, and 2.7 bars for a saturating steam temperature of 130° C. It is possible, if needed, to increase to higher saturating steam temperatures, for example 180° Celsius, 200° Celsius or even 220° Celsius by increasing pressure up to 10 bars or 15 bars respectively. The temperature and pressure rises of the process may be made in successive stages, or in ramps, or in cycles allowing optimisation of the desired result, complete 0% drying, drying down to a certain moisture content, or production of liquid exudates that can be put to chemical use. This pre-drying phase, under a determined pressure and saturating steam temperature, is maintained for the time that is necessary to move from green (minimum 65% depending upon species) to a so-called "saturation" moisture content of 30%. During this pre-drying step, it is possible to apply the microwaves to accelerate the progression from green moisture content to saturation content. When the required saturation content is reached, the residual moisture contained in the wood is prevented from exiting the wood. At this time, the microwave heating phase takes on all its importance. During the application of the microwave heating phase, the power of the microwaves emitted by the central window 14*c* may be greater than the power emitted by windows 14*l* positioned either side of the central window; the power is used so as to obtain a temperature differential in the wood which corresponds to a steam pressure differential in the wood. This pressure differential will be used so as to promote the evacuation of water towards the outside of the wood and in the direction of the fibres when the determined operating temperature has been reached. The power of the microwave generators is calculated so as to reach a wood temperature that is greater than that of the saturating steam which may be close to 120° Celsius or higher and produce the desired effect of drying from the inside towards the outside of the wood.

Given the presence of pressure and water-saturated air, the liquid chemical components and the water evacuated from the wood cannot under any circumstances be evaporated and they run down under gravity to be collected below grid 19 by siphon 18. Siphon 18 is set in operation at regular intervals by the control system as soon as the level nears the grid. The chamber comprises a level detector device allowing automatic opening of the valve 17. Each cycle of water evacuation is followed by a cycle of pressure reset in the chamber to saturating steam pressure. With this last phase it is possible to reduce the wood moisture content from 30% to the final desired content, which may be 20%, 10%, 6% or 0%. To achieve complete drying of the wood with a level approaching 0%, the process will comprise at least one phase of determined length during which the temperature will be maintained in a range of approximately 200 to 220° C. and under atmospheric pressure of saturating steam of more than 10 bars. Through the use of a saturating steam atmosphere and higher microwave temperatures, which are nonetheless lower than the temperatures generally used in so-called "cross-linking" processes in an atmosphere that is not steam saturated, it is possible to obtain wood dried to a moisture content approaching 0% and at the same time to achieve a phenomenon of natural polymerisation giving the wood humidity-resistant, dimensional stability and easy machining properties. This result is obtained in a shorter time than with known processes and above all with preservation of natural wood colour. For the process of the invention does not produce the known wood-darkening phenomenon resulting from the roasting obtained with temperatures between 240 and 300° C.

The drying process may also be used in the system of the invention to produce a liquid exudate incorporating chemical molecules which form a wood species, such as pine, eucalyptus, oak, beech, spruce etc. or a determined mixture of species. This exudate is recovered and optionally re-treated using physico-chemical methods to obtain chemical components which can be used in the cosmetics, pharmaceutical, perfume, agro-foodstuffs, chemical or insecticide industries. Therefore, if solely pine is treated, the exudate obtained will have insecticide properties.

After the time that is necessary to obtain this final moisture content, when the wood is dried, the circulation of saturating steam is halted, the steam generating circuit 2 is closed if necessary. Gates 191, 192 allowing communication with the condenser 19 are opened to enable condensation of the vapour in the chamber and to lower the temperature of the chamber. After a certain time, the microwave generator is also stopped and the pressure reduced until atmospheric pressure is gradually reached.

By placing the ambient medium around the wood under saturation, and through judicious use of microwave power with energy consumption far below usual consumption in the prior art, it is possible to accelerate the inner wood moisture evacuation process and to obtain quicker drying with less energy consumption. Mains water can be used in the sprinkling device.

Other modifications able to be conducted by persons skilled in the art also come within the spirit of the invention. Therefore, any transfer system may be used in lieu and stead of the rail-mounted wagons. Also control and regulation devices may be used to set in operation successive phases of the process in conjunction with varying degrees of automation. Also the chamber comprises a safety valve 11 allowing the chamber to be placed in contact with outside air, either at the end of the process or in the event of overpressure detected by the control system.

What is claimed is:

1. Wood drying process wherein the wood drying process comprises:

a pressurizing step to place at least one sealed chamber (1) under a determined pressure of saturating steam and maintain this pressure for a determined time interval while ensuring forced circulation of air and saturating steam within the chamber;

a heating step, to heat the wood core and all zones of the wood pieces to be dried, by emitting microwaves;

an evacuation step, to carry away the liquid exudates yielded by the wood and running down to a bottom of the chamber (1) where they are collected.

2. Wood drying process according to claim 1, wherein the liquid exudates are permanently evacuated.

3. Wood drying process according to claim 1, wherein the liquid exudates are intermittently evacuated.

4. Wood drying process according to claim 1, wherein the evacuation step is followed by a gradual pressure-lowering step down to atmospheric pressure after interruption of the microwaves emissions.

5. Wood drying process according to claim 1, wherein the evacuation step comprises a physico-chemical treatment step for the exudates to make them compatible with evacuation towards a waste water circuit.

6. Wood drying process according to claim 1, wherein the liquid exudate evacuation step is followed by a step of collection in a container for chemical re-treatment.

7. Wood drying process according to claim 4, wherein the pressure-lowering step is completed by steps of de-humidifying and cooling ambient air in the chamber.

8. Wood drying process according to claim 1, wherein applied microwave emitting powers are of decreasing magnitude from the center of the wood pieces towards the outside.

9. Wood drying process according to claim 1, wherein the pressure of saturating steam lies in a range of 2 bars to 15 bars.

10. Wood drying process according to claim 9, wherein the steam pressure is less than 10 bars to obtain a treated wood moisture content of more than 6%.

11. Wood drying process according to claim 1, wherein the steam pressure lies for at least a determined drying time between 10 and 15 bars and the produced temperature reaches a value in the range of 200 to 220° C. to obtain a dry polymerized wood having a moisture content close to 0%.

12. Wood drying process according to claim 1, wherein the power of the microwave generator is calculated so that the inner heat produced in the wood is higher than the temperature of saturating steam.

13. System enabling the implementation of the process according to claim 1, including a sealed pressure-resistant chamber (1) with an emitter for emitting microwaves being arranged crosswise to the stack of wood (3), the chamber communicating with a pressurized air recirculation pathway (12) aspirating air on one side of the wood stack (3) via grids **(13*a*) and repelling the air on the other side of the wood stack (3) by diffusion grids (13*r*)**, and pressurized steam generator connected to the chamber.

14. System according to claim 13, further comprising a steam condensing circuit (19) connected in parallel on the air recirculation circuit (12) and by selectively actuated valves (191, 192).

15. System according to claim 13, further comprising in a lowest part a gravity evacuation outlet (18) to evacuate run-off waters which is controlled by a valve (17).

16. System according to claim 13, further comprising:

one end that can be closed by an automatic door (16) to ensure sealing against pressure and microwaves;

transfer system for the loads of green wood to be dried, electrically separated from a transporter located on the other side of the automatic airlock in relation to the chamber.

17. System according to claim 13, wherein the unit formed by the chamber and pre-loading zone is encased in a second protective chamber against radiation leakage, this chamber being accessible from the outside via flexible doors.

18. System according to claim 13, wherein the microwave generator is embedded in the ground and communicates with the drying chamber via a waveguide.

19. System according to claim 13, wherein the chamber comprises a safety valve (11).

20. System according to claim 15, wherein the valve (17) is opened intermittently.

21. System according to claim 15, wherein the valve (17) is opened permanently.

22. System according to claim 15, wherein the outlet is connected to a physico-chemical treatment system to make the exudates compatible with evacuation standards for the waste water.

23. Extraction method for extracting chemical components from wood including the following steps:

injection saturing steam into a sealed chamber under a determined pressure and maintaining this pressure for a determined time interval while ensuring forced circulation of air, heating of the wood by emitting microwaves, the power of which is adapted with respect to the zone of the wood to which the power is applied, and evacuation of the liquid exudates for further extraction of chemical components therefrom.

24. Method of extracting chemical components according to claim 23, wherein treatment of a pine species leads to obtaining an exudate having insecticide properties.

25. Extraction method according to claim 23, further including treating one single type of species of green wood by applying microwaves in an atmosphere of saturating steam under determined pressure and temperature conditions.

26. Extraction method according to claim 25, further including collecting the liquid exudates produced by the treatment operation of the single species.

27. Extraction method according to claim 26, further including retreating the exudate with physico-chemical methods to extract different chemical components therefrom, which can be used in the cosmetics, perfume, agro-foodstuffs, pharmaceutical and chemical industries.

28. Wood drying process according to claim 1, wherein, during the pressurizing step, the pressure is produced by injecting steam.

29. Wood drying process according to claim 1, wherein, during the pressurizing step, the pressure is produced by creating steam.

30. Wood drying process according to claim 1, wherein, during the heating step, the wood pieces are heated by starting with their central zone.

31. System according to claim 13, wherein the emitter for emitting microwaves are windows (14) communicating with a waveguide (40) connected by impedance adapters (41) to a microwave generator.

32. System according to claim 31, wherein the windows are quartz.

33. System according to claim 31, wherein the windows are a material suitable for microwaves.

* * * * *